US008047683B2

(12) United States Patent
Olesen et al.

(10) Patent No.: US 8,047,683 B2
(45) Date of Patent: Nov. 1, 2011

(54) LIGHTING DEVICE MOUNTING SYSTEM FOR HOUSEHOLD APPLIANCE, AND ASSOCIATED APPARATUS AND METHOD

(75) Inventors: Jerry Olesen, Kinston, NC (US); Gregory Van Vooren, Greenville, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 478 days.

(21) Appl. No.: 12/395,026

(22) Filed: Feb. 27, 2009

(65) Prior Publication Data

US 2010/0218793 A1 Sep. 2, 2010

(51) Int. Cl.
*F21V 33/00* (2006.01)

(52) U.S. Cl. ..... 362/253; 362/365; 362/368; 134/56 D

(58) Field of Classification Search ..... 362/96, 362/234, 253, 364, 365, 368, 457, 647, 652, 362/655, 656; 134/56 D, 57 D, 113; 222/113
See application file for complete search history.

(56) References Cited

U.S. PATENT DOCUMENTS

| | | | | |
|---|---|---|---|---|
| 2,754,662 | A * | 7/1956 | Philipp | 62/273 |
| 3,619,592 | A | 11/1971 | Lamb | |
| 3,915,180 | A | 10/1975 | Jacobs | |
| 5,836,669 | A | 11/1998 | Hed | |
| 6,508,085 | B1 * | 1/2003 | Byrne | 68/3 R |
| 6,567,999 | B1 * | 5/2003 | Thurner | 4/597 |
| 6,949,730 | B2 * | 9/2005 | Lee et al. | 219/758 |
| 7,091,459 | B2 * | 8/2006 | Kim | 219/758 |
| 7,357,525 | B2 * | 4/2008 | Doyle | 362/101 |
| 7,380,559 | B2 | 6/2008 | Son et al. | |
| 7,928,857 | B2 * | 4/2011 | Olesen et al. | 340/686.1 |
| 2004/0240196 | A1 | 12/2004 | Wilsdorf et al. | |
| 2007/0024442 | A1 | 2/2007 | Jolley et al. | |
| 2007/0090949 | A1 | 4/2007 | Baumgartner | |
| 2007/0131259 | A1 | 6/2007 | Classen | |
| 2007/0223226 | A1 | 9/2007 | Park | |
| 2007/0285915 | A1 * | 12/2007 | Rosenau et al. | 362/101 |
| 2008/0099059 | A1 | 5/2008 | Baumgartner et al. | |

FOREIGN PATENT DOCUMENTS

| | | | |
|---|---|---|---|
| AU | 8941067 | | 9/1989 |
| DE | 36 43 307 | A1 | 6/1988 |
| DE | 102 46 187 | A1 | 4/2004 |
| EP | 1048775 | A1 | 11/2000 |
| GB | 2 187 369 | A | 9/1987 |
| JP | 2006288777 | A | 10/2006 |
| WO | WO 2007/021082 | A2 | 2/2007 |
| WO | WO 2008/065062 | A1 | 6/2008 |

* cited by examiner

*Primary Examiner* — Thomas Sember
(74) *Attorney, Agent, or Firm* — Alston & Bird LLP

(57) ABSTRACT

A lighting device mounting system for a dishwasher, and an associated apparatus and method, are provided, comprising a lighting device having a first portion disposed within a dishwasher tub portion and configured to emit light therefrom. The first portion has a larger lateral area than a receiving aperture defined by a tub wall of the tub portion. The lighting device includes a second portion engaged with the first portion, and adapted to extend through the receiving aperture. The second portion includes at least one laterally-extending flange extending laterally outward therefrom. A securing device having a medial hinge portion and an engageable locking mechanism associated with free opposing ends, is configured to interact with the second portion, opposite the tub wall from the first portion, and between the at least one laterally extending flange and the tub wall, so as to secure the lighting device to the tub wall.

18 Claims, 5 Drawing Sheets

LIGHTING DEVICE MOUNTING SYSTEM FOR HOUSEHOLD APPLIANCE, AND ASSOCIATED APPARATUS AND METHOD

BACKGROUND OF THE INVENTION

1. Field of the Invention

Aspects of the present disclosure are directed to household appliances and, more particularly, to a lighting device mounting system for a household appliance such as a dishwasher, and an associated apparatus and method.

2 . Description of Related Art

A dishwasher includes a wash tub for containing the dishware to be washed, wherein the wash tub defines a front opening. The front opening is configured to be engaged by a door for closing/sealing the front opening. The door is typically hinged at the lower end thereof such that the upper end of the door can be pivoted downward so as to permit access to the interior of the wash tub. When pivoted upward to close/seal the front opening, the door is often retained in that position by a lock mechanism. The lock mechanism may further be configured to prevent the door from being opened when the dishwasher is in operation. With this structure, the dishwasher, when installed, is often recessed underneath a countertop and between cabinets. Because the wash tub is disposed underneath the countertop, such a front-opening dishwasher may not necessarily receive sufficient ambient light in the wash tub when the door is open, and thus it may be difficult for a user to see the dishware within the wash tub under such low light conditions.

Accordingly, some dishwashers may implement one or more interior lighting devices, such as incandescent lights or LEDS, disposed within and engaged with the tub of the dishwasher. In some instances, each lighting device may be attached to the top wall of the wash tub top via a "snap" fit or "snap" mechanism engaging a respective aperture defined by the top wall of the wash tub. However, because of the high temperatures and humidity experienced about the top wall of the wash tub, a uniform and consistent seal between the lighting device and the top wall of the wash tub is often required so as to prevent moisture leakage out of the wash tub. Such a uniform and consistent seal may be difficult to achieve using the discrete snap mechanisms, since such snap mechanisms generally do not extend continuously about the lighting device.

Thus, there exists a need for a mounting system capable of mounting a lighting device to a dishwasher tub wall such that a uniform and consistent seal therebetween is achieved so as to prevent moisture leakage out of the wash tub of the dishwasher.

BRIEF SUMMARY OF THE INVENTION

The above and other needs are met by a lighting device mounting system for a dishwasher. The system comprises a lighting device having a first portion adapted to be disposed within a dishwasher tub portion and to emit light therefrom. The first portion id adapted to have a larger lateral area than a receiving aperture defined by a tub wall of the dishwasher tub portion. The lighting device further includes a second portion engaged with the first portion. The second portion is adapted to extend through the receiving aperture. The second portion further includes at least one laterally-extending flange extending laterally outward therefrom. The mounting system further comprises a securing device configured to interact with the second portion of the lighting device, opposite the tub wall from the first portion, so as to secure the lighting device to the tub wall. The securing device includes a hinge portion and free opposing ends. The free opposing ends include complementarily-configured portions of a locking mechanism configured to secure the free opposing ends together. The securing device is configured to be received about the second portion, between the at least one laterally-extending flange and the tub wall, and to be secured thereabout through engagement of the locking mechanism such that the securing device extends about the second portion, laterally outward from the at least one laterally-extending flange and outwardly of the receiving aperture, so as to secure the second portion opposite the tub wall from the first portion.

Another aspect provides a dishwashing appliance, comprising a tub portion having a plurality of tub walls defining a forward access opening, wherein at least one of the tub walls defines a receiving aperture. A lighting device has a first portion disposed within the tub portion and configured to emit light therefrom, wherein the first portion has a larger lateral area than the receiving aperture. The lighting device includes a second portion engaged with the first portion. The second portion extends through the receiving aperture, and further includes at least one laterally-extending flange extending laterally outward therefrom. A securing device is configured to interact with the second portion of the lighting device, opposite the tub wall from the first portion, so as to secure the lighting device to the tub wall. The securing device includes a hinge portion and free opposing ends. The free opposing ends include complementarily-configured portions of a locking mechanism configured to secure the free opposing ends together. The securing device is received about the second portion, between the at least one laterally-extending flange and the tub wall, and is secured thereabout through engagement of the locking mechanism such that the securing device extends about the second portion, laterally outward from the at least one laterally-extending flange and outwardly of the receiving aperture, so as to secure the second portion opposite the tub wall from the first portion.

Yet another aspect provides a method of mounting a lighting device to a tub portion of a dishwasher. Such a method comprises disposing a first portion of a lighting device within a dishwasher tub portion, wherein the first portion is configured to emit light therefrom and has a larger lateral area than a receiving aperture defined by a tub wall of the dishwasher tub portion. The method further comprises extending a second portion of the lighting device through the receiving aperture, wherein the second portion is engaged with the first portion and includes at least one laterally-extending flange extending laterally outward therefrom. The method further comprises securing the lighting device to the tub wall by engaging a securing device with the second portion of the lighting device, between the at least one laterally-extending flange and the tub wall opposite from the first portion. The securing device includes a hinge portion and free opposing ends. The free opposing ends include complementarily-configured portions of a locking mechanism configured to secure the free opposing ends together. The securing device is received about the second portion, between the at least one laterally-extending flange and the tub wall, and is secured thereabout through engagement of the locking mechanism such that the securing device extends about the second portion, laterally outward from the at least one laterally-extending flange and outwardly of the receiving aperture, so as to secure the second portion opposite the tub wall from the first portion.

Aspects of the present invention thus provide significant advantages as otherwise detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
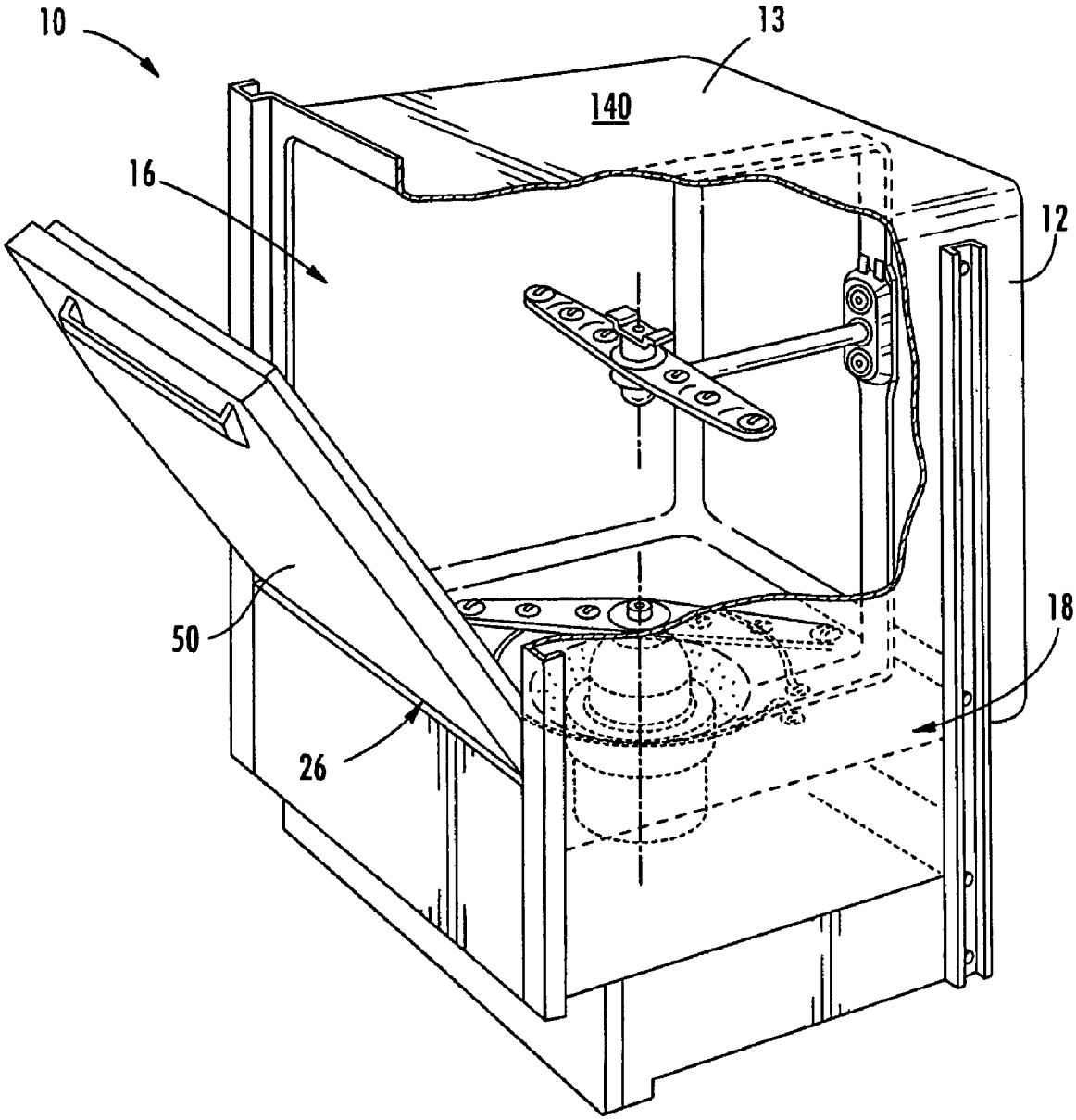
FIG. 1 is a perspective view of a dishwasher capable of implementing various embodiments of the present disclosure.

FIG. 1 illustrates one example of a dishwashing appliance, such as a dishwasher 10, capable of implementing various embodiments of the present invention. Such a dishwasher 10 typically includes a tub portion 12 (partly broken away in FIG. 1 to show internal details) having a plurality of walls (e.g., top wall 13, bottom wall 17) for forming an enclosure in which dishes, utensils, and other dishware or kitchenware may be placed for washing. The tub portion 12 may also define a forward access opening, generally designated as 16. A door assembly 50 may be pivotably engaged with the tub portion 12 about the lower end 18 thereof so as to selectively permit access to the interior of the tub portion 12. That is, a lower edge 26 of the door assembly 50 may be pivotably engaged (i.e., hinged) with the lower end 18 of the tub portion 12 such that the door assembly 50 is pivotable about the lower edge 26 thereof to provide access to the interior of the tub portion 12 through the forward access opening 16, and to cover and seal the forward access opening 16 when the dishwasher 10 is in operation. When pivoted upward to close/seal the forward access opening 16, the door assembly 50 may be retained in that position by a releasable door lock mechanism (not shown), wherein the door lock mechanism may further be configured to prevent the door assembly 50 from being opened when the dishwasher 10 is in operation.

Further, the dishwasher 10 may include one or more interior lighting devices that operate to provide artificial illumination in the interior of the tub portion 12 when the door assembly 50 is open, thereby improving a user's ability to see the dishware within the tub portion 12 when sufficient ambient light is unavailable. In some instances, the interior lighting devices may be in electrical communication with a switch element (not shown) associated with the door assembly 50. The switch element may be engaged with the door lock mechanism for the door assembly 50, and may be configured to actuate the interior lighting devices when the lock mechanism is disengaged (i.e., allows the door assembly 50 to be opened), and to de-actuate the interior lighting devices when the lock mechanism is engaged (i.e., retains the door assembly 50 in the closed position). That is, actuation and de-actuation of the interior lighting devices may be accomplished through the switch element interacting with the door lock mechanism as it is locked and unlocked, independently of whether the door assembly 50 itself is pivoted open or not. Further, in other instances, the switch element may be operable to generate an electric signal for actuating the interior lighting devices when a predetermined pivoting angle of the door assembly 50 is reached as the door assembly 50 is being opened.

The interior lighting devices may typically be disposed within the tub portion 12 and secured to one or more tub walls (e.g., top wall 13) so as to illuminate the interior of the tub portion 12. In this regard, the interior lighting devices may be mounted to the respective walls through apertures defined by those tub walls. Further, such apertures may allow electrical wiring associated with the interior lighting devices to be run to the exterior of the tub portion 12 wherein such wiring is in communication with the overall electrical system of the dishwasher 10 so as to be, for example, in electrical communication with a controller device and/or a switch element (i.e., associated with the releasable door locking mechanism, as described previously). In some instances, user actuated controls (e.g., buttons, knobs, touch controls) may be in operable communication with such controller devices to allow a user to control illumination of the interior lighting devices. In any event, since the apertures represent breaches of the integrity/continuity of the respective tub wall, such apertures associated with the interior lighting devices may provide possible leakage routes through which moisture may undesirably leak out of the tub portion 12. As mentioned previously, some conventional mounting systems for securing the interior lighting devices within apertures defined by the tub wall may not necessarily provide, for example, due to high temperatures and humidity experienced within the tub portion 12, a uniform and consistent seal between the interior lighting device and tub wall of the tub portion 12. In this regard, such a desirable uniform and consistent seal may be difficult to achieve through, for example, a mounting system comprising discrete snap mechanisms that generally do not extend continuously about the interior lighting device.

Figure 2:
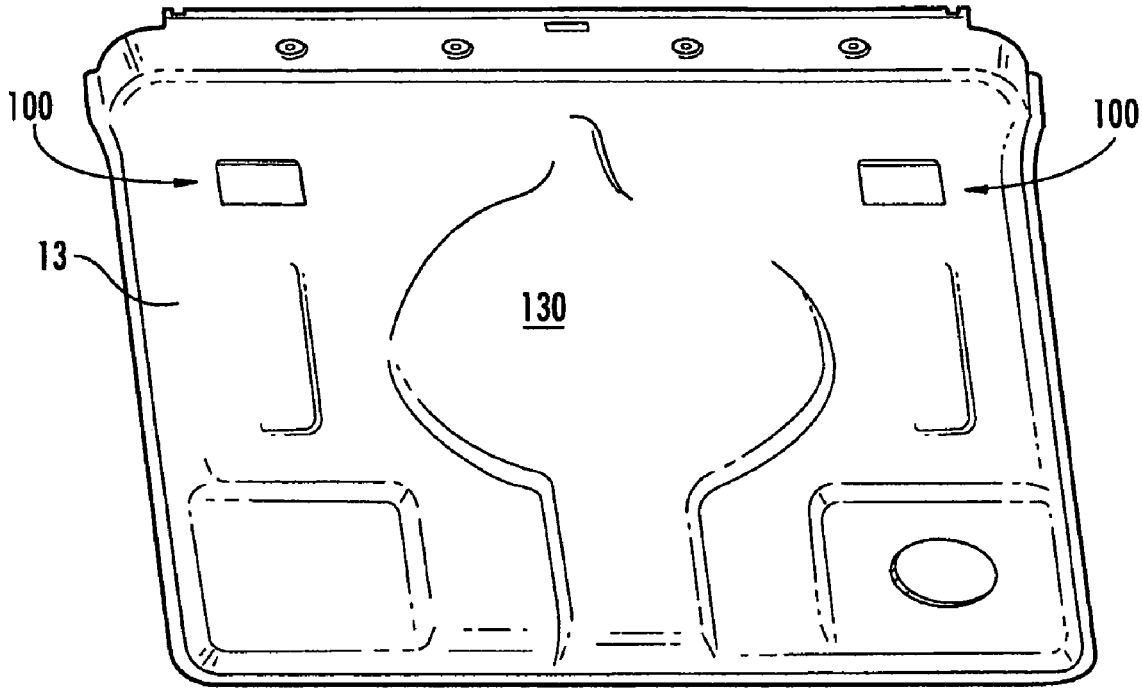
FIG. 2 is a perspective view of a dishwasher tub wall having a pair of lighting devices engaged therewith, according to one embodiment of the present disclosure.
Figure 3:
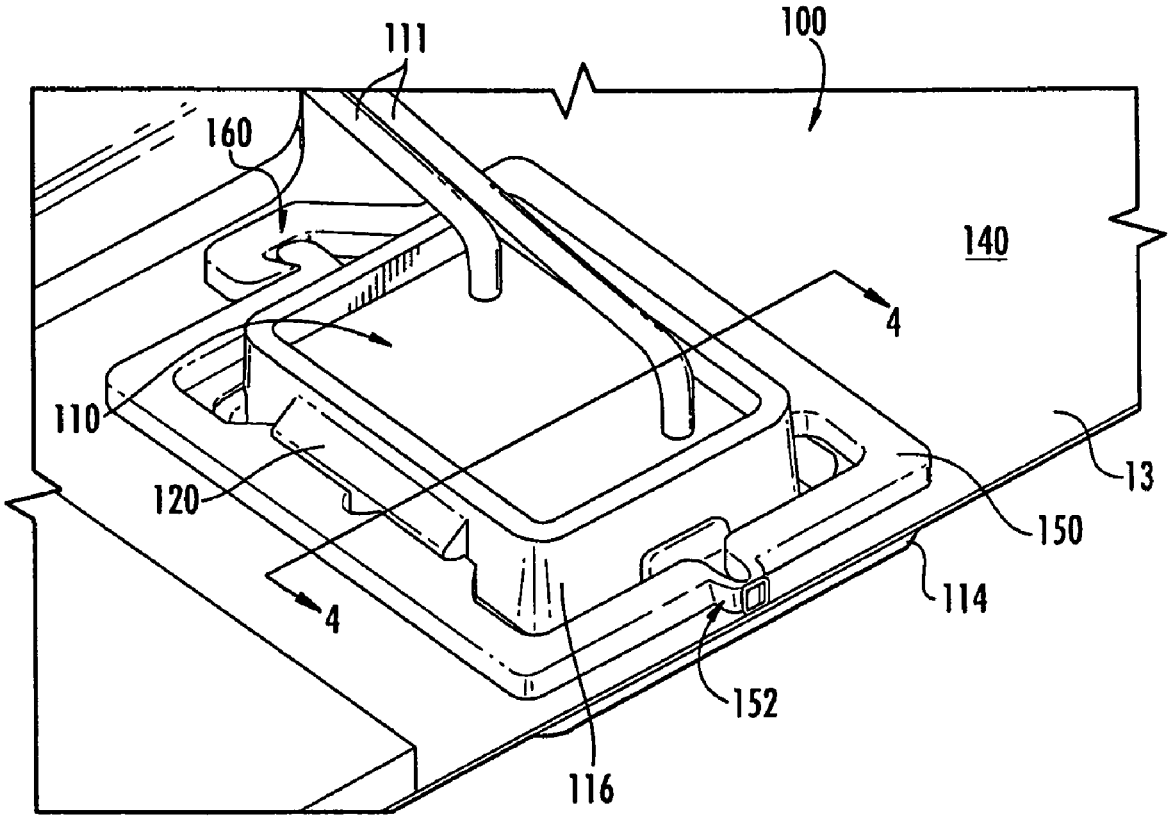
FIG. 3 is a partial perspective view of a dishwasher tub wall having a lighting device mounting system engaged therewith, according to one embodiment of the present disclosure.

Referring to FIGS. 2-5, therein is shown a lighting device mounting system 100 configured in accordance with an exemplary embodiment of the present invention. One or more mounting systems 100 may be used, for example, in the dishwasher 10, wherein a lighting device 110 forms a portion of each overall mounting system 100 such that the lighting device 110 may be mounted or otherwise secured to a tub wall, such as, for example, top wall 13, so as to provide illumination within the interior of the tub portion 12. The mounting system 100 generally includes the lighting device 110 and a securing device 150 such as, for example, a clip device, wherein the lighting device 110 may be at least partially received through a receiving aperture 105 defined by a tub wall of the tub portion 12. As described herein, the mounting system 100 may be configured to engage the top wall 13 of the tub portion 12, within the interior of the tub portion 12. In this manner, since the top wall is generally below a user's eye level when the dishwasher is installed, the lighting device 110 is relatively less visible compared to being mounted elsewhere within the tub portion 12, and provides "top down" illumination of all of the contents of the dishwasher 10. However, the mounting system 100 may be otherwise engaged with other tub walls, as appropriate. Further, while a pair of lighting devices 110 is shown in FIG. 2, any number of lighting devices (and associated mounting systems) may be provided within the tub portion 12, as desired.

Figure 4:
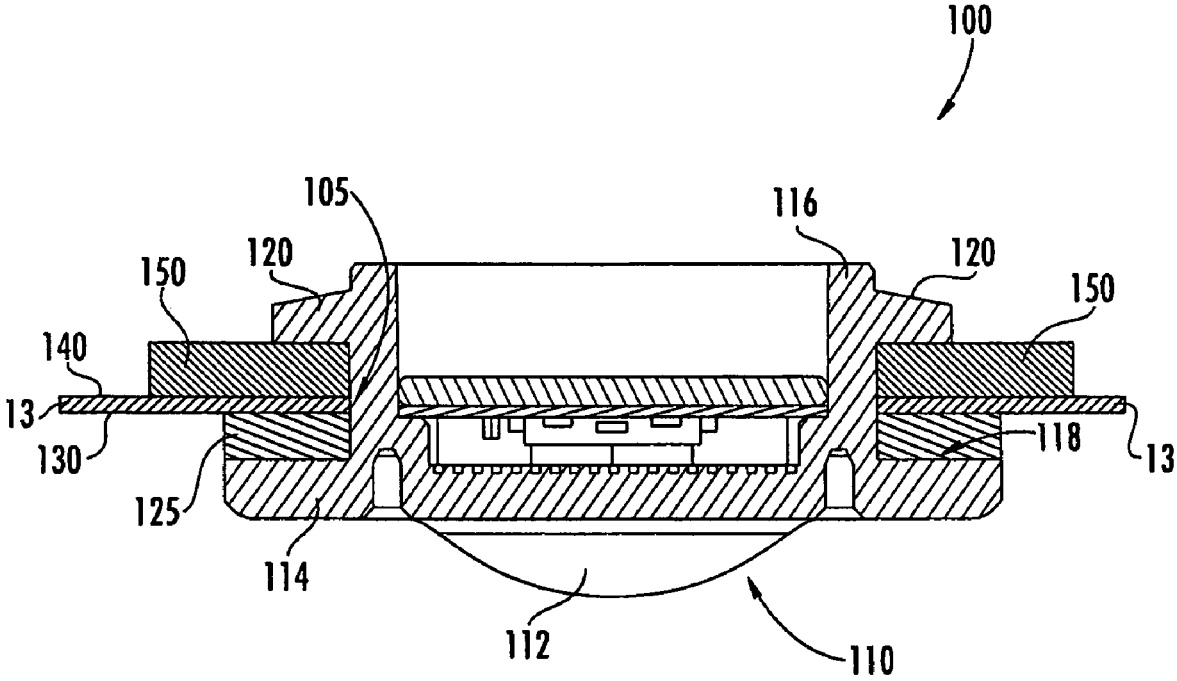
FIG. 4 is a cross-section of the dishwasher tub wall and lighting device mounting system taken along line 4-4 of FIG. 3.
Figure 5:
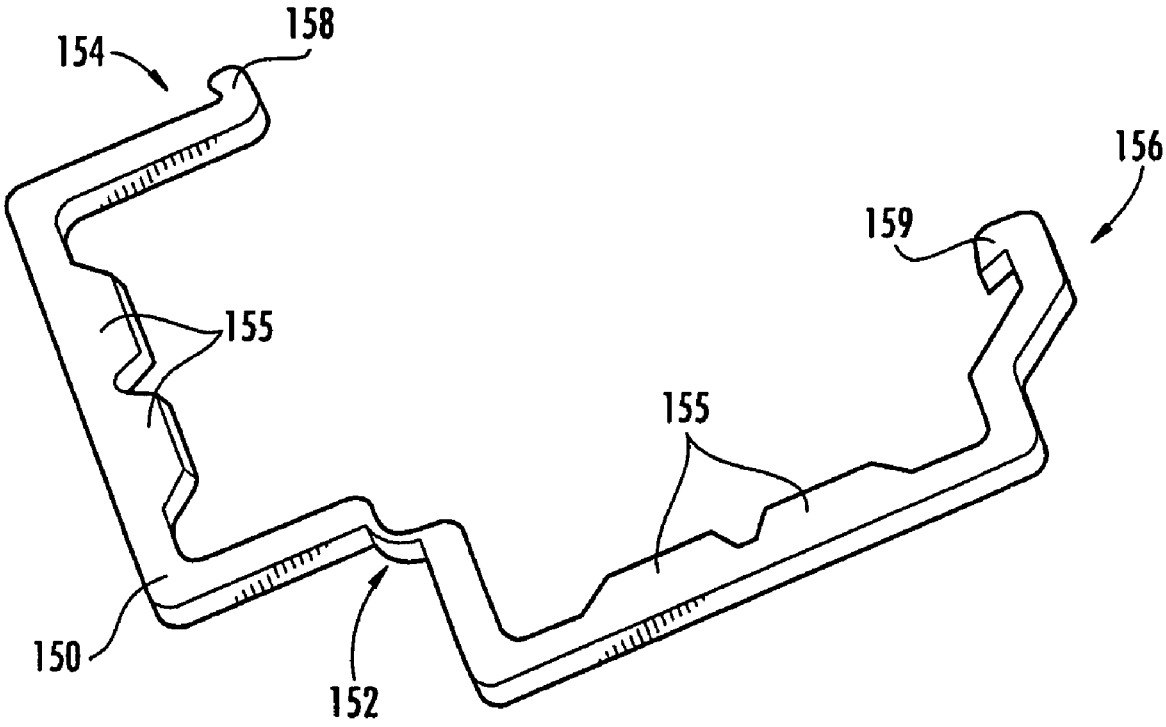
FIG. 5 is a perspective view of a securing device configured in accordance with an exemplary embodiment of the present disclosure.

In one instance, the lighting device 110 may include a lighting element 112 adapted to be disposed within the tub portion 12 and configured to provide illumination of the contents of the dishwasher 10. In some instances, the lighting element 112 may include an LED-based component (e.g., a light-emitting diode), an incandescent bulb component, or other suitable lighting component. Each lighting device 110 may comprise a first portion 114 configured to be disposed within the tub portion 12, wherein the first portion 114 may also include the lighting element 112 so as to be configured to emit light therefrom (i.e., as a lens and surrounding bezel). As shown in FIG. 4, the first portion 114 may be generally larger in lateral area than the lateral area of the receiving aperture 105 defined by the top wall 13. In one instance, the first portion 114 extends laterally outward of all boundaries of the receiving aperture 105. Further, the lighting device 110 may include a second portion 116 engaged with the first portion 114, wherein the second portion 116 is configured to fit or otherwise extend through the receiving aperture 105 defined by the top wall 13. In some instances, the second portion 116 may be substantially centered with respect to the first portion 114, such that a "lip" portion 118 is defined by and between the first portion 114 and the second portion 116 (i.e., about the perimeter of the second portion 116) of the lighting device 110, wherein the lip portion 118 may be configured to optionally receive a gasket member 125 extending contiguously thereabout, as further described herein. In addition, the lighting device 110 may include appropriate wiring 111 associated therewith, wherein the wiring 111 extends from the lighting device 110 and through the second portion 116 into electrical communication with the overall wiring scheme of the dishwasher 10. In some instances, the wiring 111 may be in electrical communication with a switch element (not shown) associated with the door lock mechanism, as described previously.

In some instances, the second portion 116 may further include one or more horizontally-extending flanges 120 extending laterally outward therefrom. In order to secure the lighting device 110 within the receiving aperture 105 such that the first portion 114 (or the gasket member 125, when provided) forms the necessary seal with the tub wall (e.g., top wall 13), a securing device 150 may be configured to interact with the second portion 116 of the lighting device 110, externally of the tub portion 12, so as to retain the lighting device 110 in engagement with the receiving aperture 105 while compressing the first portion 114 and/or the gasket member 125 against the top wall so as to form the seal therebetween (i.e., to prevent moisture leakage). For example, at least a portion of the first portion 114 may be configured to interface with an interior side 130 of the top wall 13, and at least a portion of the second portion 116 configured to extend through the receiving aperture 105 such that the securing device (e.g., securing device 150) may be positioned about an exterior side 140 of the top wall 13 and engaged about the second portion 116, between the top wall 13 and the flanges 120 so as to secure the second portion 116 and, in turn, the lighting device 110 to the top wall 13.

According to some embodiments, the securing device 150 may be provided so as to extend about the second portion 116 externally to the interior of the tub portion 12. In some instances, the securing device 150 extends for 360 degrees about the second portion 116, and may be configured to extend laterally from under the horizontally-extending flanges 120 of the second portion 116 and outwardly of the receiving aperture 105 to engage the top wall 13 of the tub portion 12 about the perimeter of the receiving aperture 105. In this regard, the lighting device 110 may thus be urged into the receiving aperture 105 so as to force the first portion 114 of the lighting device 110 into contact with the interior side 130 of the top wall 13 (and/or to compress the gasket member 125 therebetween). The securing device 150 may be then installed about the second portion 116, on the exterior side 140 of the tub portion 12, to engage the horizontally-extending flanges 120 of the second portion 116 of the lighting device 110, between the flanges 120 and the top wall 13, to secure the lighting device 110 within the receiving aperture 105 while keeping the first portion 114 in contact with the interior side 130 of the top wall 13.

In order to facilitate the installation of the securing device 150, the securing device 150 may be configured to include, for example, a hinge portion 152. The hinge portion 152 thus necessitates a discontinuity in the securing device 150, generally opposite to the hinge portion 152, so as to allow the hinge portion to function as intended, and to allow the securing device 150 to be installed about the second portion 116 of the lighting device 110, as previously disclosed. The hinge portion 152 may be integrally or monolithically formed with the remainder of the securing device 150 such that a single-piece member may be used. That is, the securing device 150 may be integrally formed such that the hinge portion opposes, but otherwise couples the portions leading to the free opposing ends 154, 156. As such, in some instances, the securing device 150 (and hinge portion 152) may be comprised of a resilient material, such as, for example, a polymer material, that allows the free opposing ends 154, 156 of the securing device 150 to be moved apart and together through the operation of the hinge portion 152. In one particular embodiment, the hinge portions 152 may be a living hinge, wherein the living hinge is defined as a thin flexible hinge portion (or flexure bearing) made from a polymer material (e.g., plastic) that joins two rigid polymer material parts (i.e., the portions of the securing device 150 leading to the free opposing ends 154, 156) together, allowing them to bend along the line of the hinge portion. In other instances, the hinge portion 152 may be separately formed from the other components comprising the securing device 150. For example, the hinge mechanism may comprise a pin element (not shown) configured to attach two components of the securing device 150 together so as to allow both to pivot about the pin element.

To facilitate installation (or removal) of the securing device 150, the free opposing ends 154, 156 of the securing device 150 on either side of the discontinuity may be configured to include complementary portions 158, 159 of a locking mechanism 160 (see FIG. 3) for securing the free opposing ends 154, 156 together. For example, in one particular embodiment, the complementary portions 158, 159 may include a latch portion and a hook portion, respectively, wherein the hook portion extends about the latch portion to lock the two portions together through, for example, a snap or interference fit, so as to prevent the free opposing ends 154, 156 from being laterally separated. As shown, the locking mechanism 160 can be engaged (or disengaged) by one hand of an operator, so as to secure the securing device 150 about the second portion 116 of the lighting device 110, while the operator's other hand urges the lighting device 110 into the receiving aperture 105 so as to contact the first portion 114 with the interior side 130 of top wall 13 and/or to compress the gasket member 125 therebetween. The securing device 150 may further include one or more laterally-extending portions 155, which are configured to engage and interact with the horizontally-extending flanges 120 of the second portion 116, between the flanges 120 and the top wall 13, to maintain a desired compressive force between the lighting device 110 and the top wall 13. In some instances, the securing device 150 may be configured to be received about the second portion 116, between the one or more horizontally-extending flanges 120 and the tub wall (e.g., top wall 13), in and along a securing plane disposed parallel to the tub wall (e.g., top wall 13), and the portions of the locking mechanism 160 are configured to interact along the securing plane so as to secure the free opposing ends 154, 156 together.

In some instances, the lighting device mounting system 100 may include an optional gasket member 125 or resilient member that serves to provide a moisture seal at the wall 13—lighting device 110 interface. The gasket member 125 may be comprised of a resilient polymer material or any other suitable material capable of providing a fluid-tight seal at the receiving aperture 105. In one instance, the gasket member 125 may be configured to form a seal between the lip portion 118 of the lighting device 110 and the top wall 13 of the tub portion 12, about the receiving aperture 105 defined thereby, so as to provide the necessary moisture seal. The gasket member 125 may be used in conjunction with the securing device 150 to provide such a moisture seal at the wall 13—lighting device 110 interface. As shown, the locking mechanism 160 can be engaged (or disengaged) by one hand of an operator, so as to secure the securing device 150 about the second portion 116 of the lighting device 110, while the operator's other hand urges the lighting device 110 into the receiving aperture 105 so as to compress the gasket member 125 between the lip portion 118 and the top wall 13. That is, the securing device 150 may be installed on the exterior side 140 of the tub portion 12 to engage the horizontally-extending flanges 120 of the second portion 116 of the lighting device 110, between the flanges 120 and the exterior side 140 of the top wall 13, to secure the lighting device 110 within the receiving aperture 105 while keeping the gasket member 125 compressed. In this manner, the configuration of the securing device 150 and cooperation therewith of the second portion 116 of the lighting device 110 facilitates manufacturability, as well as a substantially uniform securement of the gasket member 125 about the lighting device 110 so as to provide a moisture seal of high integrity.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A lighting device mounting system for a dishwasher, comprising:

a lighting device having a first portion adapted to be disposed within a dishwasher tub portion and to emit light therefrom, the first portion being adapted to have a larger lateral area than a receiving aperture defined by a tub wall of the dishwasher tub portion, and a second portion engaged with the first portion and adapted to extend through the receiving aperture, the second portion further including at least one laterally-extending flange extending laterally outward therefrom; and a securing device configured to interact with the second portion of the lighting device, opposite the tub wall from the first portion, so as to secure the lighting device to the tub wall, the securing device including a hinge portion and free opposing ends, the free opposing ends having complementarily-configured portions of a locking mechanism configured to secure the free opposing ends together, the securing device being configured to be received about the second portion, between the at least one laterally-extending flange and the tub wall, and to be secured thereabout through engagement of the locking mechanism such that the securing device extends about the second portion, laterally outward from the at least one laterally-extending flange and outwardly of the receiving aperture, so as to secure the second portion opposite the tub wall from the first portion.

2. A system according to claim 1 wherein the securing device is integrally formed such that the hinge portion couples the free opposing ends.

3. A system according to claim 1 wherein one portion of the locking mechanism comprises a hook portion and the other portion of the locking mechanism comprises a latch portion, the hook portion being configured to interact with and receive the latch portion in an interference fit so as to prevent the opposing ends from being laterally separated.

4. A system according to claim 1 wherein the second portion is substantially centered with respect to the first portion such that a lip portion is defined by and between the first and second portions of the lighting device, and the system further comprises a gasket member configured to extend continuously about the lip portion and to be received thereby, the gasket member being configured to form a seal between the lip portion and the tub wall, about the receiving aperture defined thereby, upon securement of the securing device about the second portion.

5. A system according to claim 1 wherein the securing device is comprised of a resilient polymer material.

6. A system according to claim 1 wherein the securing device is configured to be received about the second portion, between the at least one laterally-extending flange and the tub wall, in a securing plane parallel to the tub wall, and the portions of the locking mechanism are configured to interact along the securing plane so as to secure the free opposing ends together.

7. A dishwashing appliance, comprising:

a tub portion having a plurality of tub walls defining a forward access opening, at least one of the tub walls defining a receiving aperture;

a lighting device having a first portion disposed within the tub portion and configured to emit light therefrom, the first portion having a larger lateral area than the receiving aperture, and a second portion engaged with the first portion and extending through the receiving aperture, the second portion further including at least one laterally-extending flange extending laterally outward therefrom; and a securing device configured to interact with the second portion of the lighting device, opposite the tub wall from the first portion, so as to secure the lighting device to the tub wall, the securing device including a hinge portion and free opposing ends, the free opposing ends having complementarily-configured portions of a locking mechanism configured to secure the free opposing ends together, the securing device being received about the second portion, between the at least one laterally-extending flange and the tub wall, and being secured thereabout through engagement of the locking mechanism such that the securing device extends about the second portion, laterally outward from the at least one laterally-extending flange and outwardly of the receiving aperture, so as to secure the second portion opposite the tub wall from the first portion.

8. A dishwashing appliance according to claim 7 wherein the securing device is integrally formed such that the hinge portion couples the free opposing ends.

9. A dishwashing appliance according to claim 7 wherein one portion of the locking mechanism comprises a hook portion and the other portion of the locking mechanism comprises a latch portion, the hook portion being configured to interact with and receive the latch portion in an interference fit so as to prevent the opposing ends from being laterally separated.

10. A dishwashing appliance according to claim 7 wherein the second portion is substantially centered with respect to the first portion such that a lip portion is defined by and between the first and second portions of the lighting device, and the system further comprises a gasket member configured to extend continuously about the lip portion and to be received thereby, the gasket member being configured to form a seal between the lip portion and the tub wall, about the receiving aperture defined thereby, upon securement of the securing device about the second portion.

11. A dishwashing appliance according to claim 7 further comprising a door assembly pivotably engaged with the tub portion about a lower end thereof and configured to cover the forward access opening, and a releaseable door lock mechanism operably engaged between the door assembly and the tub portion, the door lock assembly having a switch element associated therewith and in electrical communication with the lighting device, the switch element being configured to actuate the lighting device in response to disengagement of the door lock mechanism, and to de-actuate the lighting device in response to engagement of the door lock mechanism.

12. A dishwashing appliance according to claim 7 wherein the lighting device comprises a light-emitting diode.

13. A dishwashing appliance according to claim 7 wherein the securing device is comprised of a resilient polymer material.

14. A dishwashing appliance according to claim 7 wherein the securing device is configured to be received about the second portion, between the at least one laterally-extending flange and the tub wall, in a securing plane parallel to the tub wall, and the portions of the locking mechanism are configured to interact along the securing plane so as to secure the free opposing ends together.

15. A method of mounting a lighting device to a tub portion of a dishwasher, the method comprising:

disposing a first portion of a lighting device within a dishwasher tub portion, the first portion being configured to emit light therefrom and having a larger lateral area than a receiving aperture defined by a tub wall of the dishwasher tub portion;

extending a second portion of the lighting device through the receiving aperture, the second portion being engaged with the first portion and including at least one laterally-extending flange extending laterally outward therefrom; and securing the lighting device to the tub wall by engaging a securing device with the second portion of the lighting device, between the at least one laterally-extending flange and the tub wall opposite from the first portion, the securing device including a hinge portion and free opposing ends, the free opposing ends having complementarily-configured portions of a locking mechanism configured to secure the free opposing ends together, the securing device being received about the second portion, between the at least one laterally-extending flange and the tub wall, and being secured thereabout through engagement of the locking mechanism such that the securing device extends about the second portion, laterally outward from the at least one laterally-extending flange and outwardly of the receiving aperture, so as to secure the second portion opposite the tub wall from the first portion.

16. A method according to claim 15 wherein securing the lighting device further comprises engaging one portion of the locking mechanism comprising a hook portion with the other portion of the locking mechanism comprising a latch portion, the hook portion being configured to interact with and receive the latch portion in an interference fit so as to prevent the opposing ends from being laterally separated.

17. A method according to claim 15 further comprising engaging a gasket member with a lip portion defined by and between the first and second portions of the lighting device, the second portion being substantially centered with respect to the first portion, such that the gasket member extends continuously about the lip portion, the gasket member being configured to form a seal between the lip portion and the tub wall, about the receiving aperture defined thereby, upon securement of the securing device about the second portion.

18. A method according to claim 15 wherein securing the lighting device further comprises installing the securing device about the second portion, between the at least one laterally-extending flange and the tub wall, in a securing plane parallel to the tub wall, and urging the portions of the locking mechanism into interaction along the securing plane so as to secure the free opposing ends together.

* * * * *